US006955225B2

(12) United States Patent
Heinonen

(10) Patent No.: US 6,955,225 B2
(45) Date of Patent: Oct. 18, 2005

(54) METHOD OF AND APPARATUS FOR SECURING CAPILLARY TUBING IN A WELLHEAD

(75) Inventor: Robert L. Heinonen, Dallas, TX (US)

(73) Assignee: Double-E Inc., Dallas, TX (US)

( * ) Notice: Subject to any disclaimer, the term of this patent is extended or adjusted under 35 U.S.C. 154(b) by 37 days.

(21) Appl. No.: 10/366,970

(22) Filed: Feb. 13, 2003

(65) Prior Publication Data

US 2004/0159440 A1 Aug. 19, 2004

(51) Int. Cl.[7] ..... E21B 19/22; E21B 33/04

(52) U.S. Cl. ..... 166/382; 166/75.14; 166/84.4; 166/77.2

(58) Field of Search ..... 166/384, 385, 166/379, 382, 77.2, 84.4, 75.14

(56) References Cited

U.S. PATENT DOCUMENTS

| | | | | | |
|---|---|---|---|---|---|
| 1,641,921 | A | * | 9/1927 | Crowell | 285/123.13 |
| 2,458,270 | A | * | 1/1949 | Humason | 417/90 |
| 3,478,826 | A | * | 11/1969 | Barnes | 166/301 |
| 3,675,719 | A | * | 7/1972 | Slator et al. | 166/297 |
| 3,692,107 | A | * | 9/1972 | Slator et al. | 166/55 |
| 4,541,490 | A | * | 9/1985 | Bigbie et al. | 166/379 |
| 4,927,112 | A | | 5/1990 | Wilson | |
| 5,092,400 | A | * | 3/1992 | Jagert | 166/88.2 |
| 5,522,464 | A | * | 6/1996 | Piper | 166/77.2 |
| RE36,723 | E | * | 6/2000 | Moore et al. | 166/242.2 |
| 6,089,338 | A | * | 7/2000 | Bouligny, Jr. | 175/423 |
| 6,543,546 | B2 | * | 4/2003 | Kaiser | 166/382 |

* cited by examiner

*Primary Examiner*—David Bagnell
*Assistant Examiner*—T. Shane Bomar
(74) *Attorney, Agent, or Firm*—Jenkens & Gilchrist, P.C.

(57) ABSTRACT

A body having a bore therethrough for insertion of capillary tubing. A first means slidably coupled into the bore of the body frictionally restrains movement of the tubing by hydraulically engaging the periphery of the tubing with an elastomeric compressible sealing member. A second means slidably coupled into the bore of the body prevents movement of the tubing in the bore of the body by hydraulically actuating a plurality of slips to impart select engagement of the periphery of the tubing for its securement therein. A third means suspends the tubing in the bore of the body by manually engaging a plurality of suspension slips around the periphery of the tubing.

14 Claims, 7 Drawing Sheets

METHOD OF AND APPARATUS FOR SECURING CAPILLARY TUBING IN A WELLHEAD

BACKGROUND OF THE INVENTION

1. Field of Invention

The present invention relates to a pack-off method and apparatus for wellheads and, more particularly, but not by way of limitation, to a system for and method of controlling the movement of small diameter tubing into and out of natural gas wells while providing means for preventing the tubing from being blown out of the well.

2. History of Related Art

It is a common and well known practice in the oil and gas industry to use wellhead devices which will confine pressure in a well around a member such as a polished rod or wireline extending into a well during emergency conditions, as well as when it is necessary for servicing the well. It is well known for example that the production rates from natural gas wells can be adversely affected by corrosion and the buildup of substances such as scale, paraffin and salt. Producers have traditionally treated the wells by inserting chemicals and soap sticks at the wellhead and relying on gravity to carry the treating agent down the well to where it is needed. Recently a much more effective treatment means has been developed. Small diameter tubing is inserted into the well and the treating chemical is pumped down this capillary tubing, usually ¼ or ⅜ inch (sometimes ⅝ inch), under pressure and allowed to enter the well where it can do the most good. A check valve at the lower end of the tubing controls the release of chemical and prevents well pressure from escaping up the capillary tubing.

"A service rig is employed to insert or "snub in" the capillary tubing while the well remains pressurized. In this way, the service company does not "kill the well" by pumping water and/or mud into the well casing to build up hydrostatic" pressure head which contains the well pressure. Accordingly, the wellhead must have a means for sealing around the capillary tubing both while it is being inserted or removed from the well and also on a long-term basis while the well is producing with the capillary tubing in place.

In operation, the insertion of the tubing can be problematic and has been analogized to Apushing on a string, @ due to the pressure within the well. When the weight of the tubing is less than the upward force or thrust in the well due to the pressure therein acting on the tubing, problems can occur. Once a sufficient depth is reached during tube insertion resulting in the weight of the tubing being sufficient to overcome the upward force or thrust in the well, the so-called "balance point" has been crossed. Likewise, when retrieving the tubing, the same phenomenon can occur as the weight of the tubing depending from the wellhead within the well decreases to the point that the weight is not sufficient to overcome the upward force or thrust placed there against.

Although systems are available for controlling the capillary tubing being inserted through a wellhead, problems exist when the tubing is above the balance point as referenced above. Typically, a spool of capillary tubing is disposed adjacent the wellhead in conjunction with a means for guiding the tubing into and through the wellhead. Such spools and guiding mechanisms are powered, and if for some reason, the power unit providing the appropriate power were to fail, the possibility exists that an operator could lose control of the tubing when it is above the balance point. While it is known in the art to use sealing members around the capillary tubing for insertion into the well, problems ensue in securely retaining the tubing within the sealing members while performing the above-referenced operations.

The present invention provides a means for quickly regaining control of tubing within a wellhead that has for one reason or the other not been secured by the conventional, compressible pack-off and securing mechanism currently in use. Although slip caps, used in conjunction with manual slips functioning as locking chucks having serrated teeth extending inwardly toward the capillary tubing may be used to permanently secure tubing, such mechanisms, which require manual actuation and/or twisting with a wrench to impart threaded induced movement therefrom, is not feasible and clearly provides safety issues for the operator. It would be a distinct advantage to provide an hydraulically actuated mechanism capable of reliable operation in the event of a capillary tubing control problem.

SUMMARY OF INVENTION

The present invention relates to a pack-off method and apparatus for wellheads. More particularly, the present invention relates to a system and method for controlling the movement of small diameter tubing into and out of wells while providing means for preventing the tubing from being blown out of the well. In one aspect, the invention includes a wellhead pack-off system for controlling the movement of small diameter tubing into and out of a well, comprising a body with a bore therethrough for insertion of the tubing, first means slidably coupled into the bore of the body for preventing movement of the tubing by hydraulically engaging a plurality of slips around the periphery of the tubing, and second means slidably coupled into the bore of the body for frictionally restraining movement of the tubing by hydraulically engaging the periphery of the tubing with a compressible elastomeric sealing member.

In another aspect of the invention, the body includes an upper unit and a lower unit. The lower unit is in threaded engagement with the upper unit. The upper unit comprises a first, second and third threaded aperture in communication with the bore of the upper unit. The upper unit further comprises the first means having a hollow cylindrical piston slidably coupled within the bore of the upper unit and in axial alignment therewith, a plurality of slips coupled to the piston and having serrated teeth for engagement or disengagement of the tubing, a slide member slidably coupled within the first aperture and extending therethrough for disengaging the plurality of slips from around the periphery of the tubing, and a plug, adapted for threaded engagement with the first aperture and disposed atop the slide for positioning the slide relative to the sidewall of the bore of the upper body. The flow of hydraulic fluid through the third aperture imparts an upward force to the piston thereby imparting a radially inwardly motion to the plurality of slips due to the inclined side walls of the bore of the upper unit so as to cause engagement of the plurality of slips with the tubing. Similarly, the flow of hydraulic fluid through the second aperture imparts a downward motion to the piston thereby imparting a radially outwardly motion to the plurality of slips due to engagement of the plurality of slips with the slide.

The lower unit further comprises a threaded aperture in communication with the bore of the lower unit. The lower unit also comprises the second means having a plunger in axial alignment therewith, a spring in axial alignment with the plunger, an upper bushing set disposed within the lower end of the plunger, a conically shaped lower bushing set in axial alignment with the upper bushing set, and a compressible elastomeric sealing member in axial alignment with the upper and lower bushing set and disposed therebetween. The flow of hydraulic fluid through the aperture of the lower unit imparts a downward force to the plunger, which compresses the spring and forces the upper bushing set into the lower bushing set, thereby compressing the sealing member disposed therebetween. The abutting engagement of the sealing member and the conically shaped lower bushing set imparts radially inwardly motion to the sealing member. The radially inwardly movement of the sealing member forms a seal around the capillary tubing extending through the bore of the body.

In still another aspect of the invention, the upper unit further comprises suspension means for suspending the tubing by engaging a plurality of suspension slips around the periphery of the tubing. The suspension means further comprises a slip cap in threaded engagement with the upper unit for engaging the suspension slips with the tubing.

In a further aspect, the invention provides an extra set of slips that can be quickly engaged around the capillary tubing described above, to arrest upward movement in an emergency situation. A double-acting hydraulic piston is used to move the slips upwards into an engaged position to halt the upward movement of the tubing. After the crew regains control, hydraulic pressure can be applied to the opposite side of the piston to move the slips downwardly and outwardly into a position that allows free upward or downward motion of the capillary tubing.

BRIEF DESCRIPTION OF THE DRAWINGS

The present invention will now be described in more detail with reference to preferred embodiments of the present invention, given only by way of examples, and illustrated in the accompanying drawings in which.

DETAILED DESCRIPTION

Figure 1:
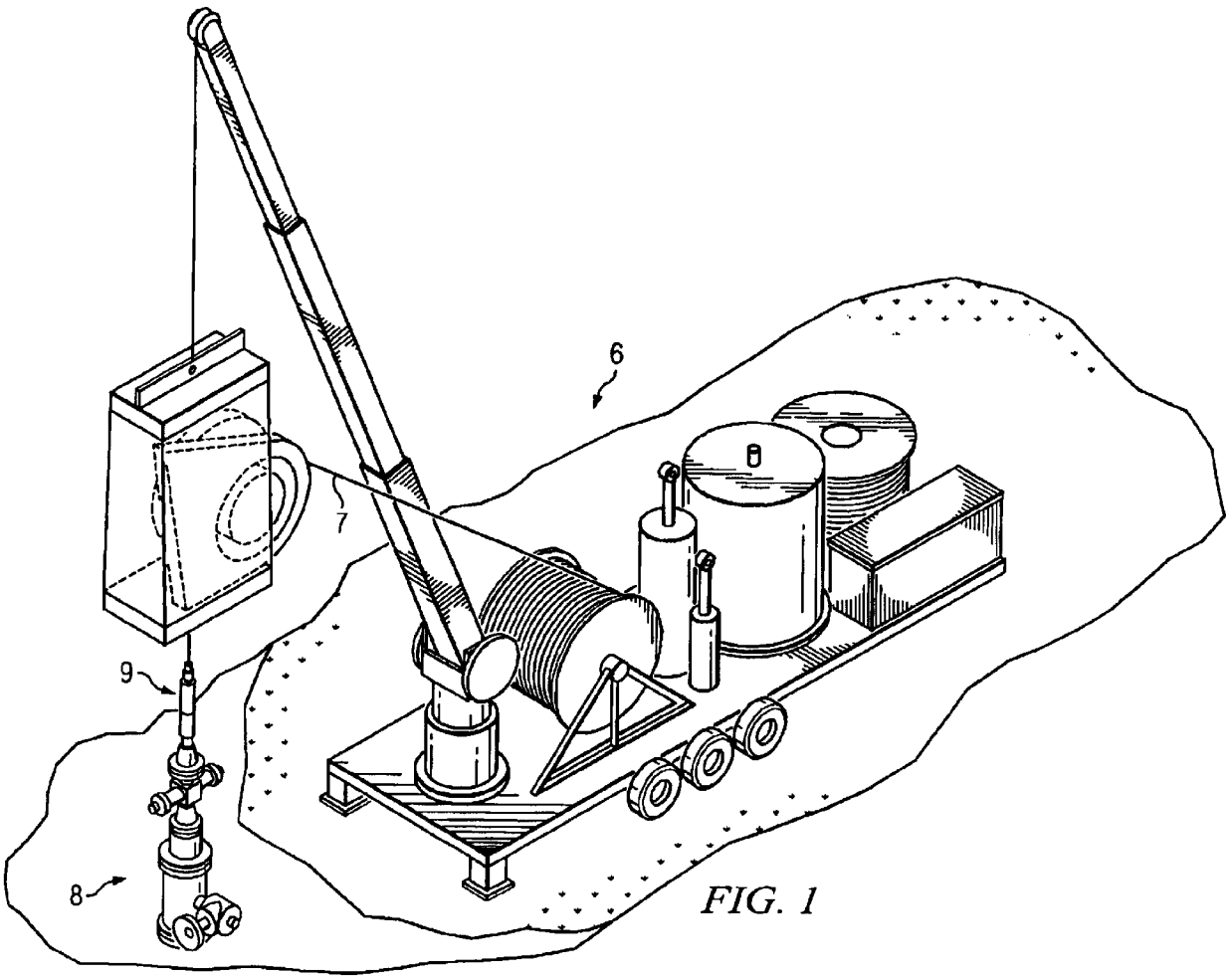
FIG. 1 is a perspective view of a typical wellhead installation showing the insertion of capillary tubing.

It has been found that a wellhead pack-off incorporating hydraulically actuated sealing means in the configuration set forth and described below may enhance the operational efficiencies surrounding the insertion or removal of capillary tubing into or out of a well under pressure. The hydraulically actuated sealing means of the present invention also provides a means for suspending the capillary tubing from the wellhead for a prolonged period of time. As described below, and as set forth and shown in the drawings, the wellhead pack-off of the present invention provides a set of hydraulically activated slips specifically adapted for restraining the capillary tubing if it begins to be blown out of the well under pressure.

Referring first to FIG. 1, there is shown a typical installation by a service rig 6 of capillary tubing 7 at a wellhead 8 utilizing a prior art pack-off 9 specifically adapted for the receipt of the capillary tubing therethrough. The wellhead 8 as shown herein utilizes the typical hardware associated with wellheads, including the wellhead pack-off 9 disposed in an upper portion thereof with the capillary string extending therefrom. It is known in the prior art to use wellhead pack-off devices for controlling the capillary tubing while the well remains pressurized. As set forth above, there are many advantages to the utilization of capillary tubing. The well operator's expectations from the use of such tubing includes obtaining incremental increases in production and reserves, and the elimination of production fluctuations associated with soaping, flaring, and stop cocking. Also, the use of capillary tubing have been shown to reduce downtime and time requirements to maintain production while improving efficiency and effectiveness of chemical treatments and applications. In wells with liquid loading, the benefits of capillary tubing include the improvement of system dynamics and minimization of reservoir damage. The present invention facilitates the above advantages by increasing the reliability of the wellhead pack-off as set forth and described below.

Figure 2:
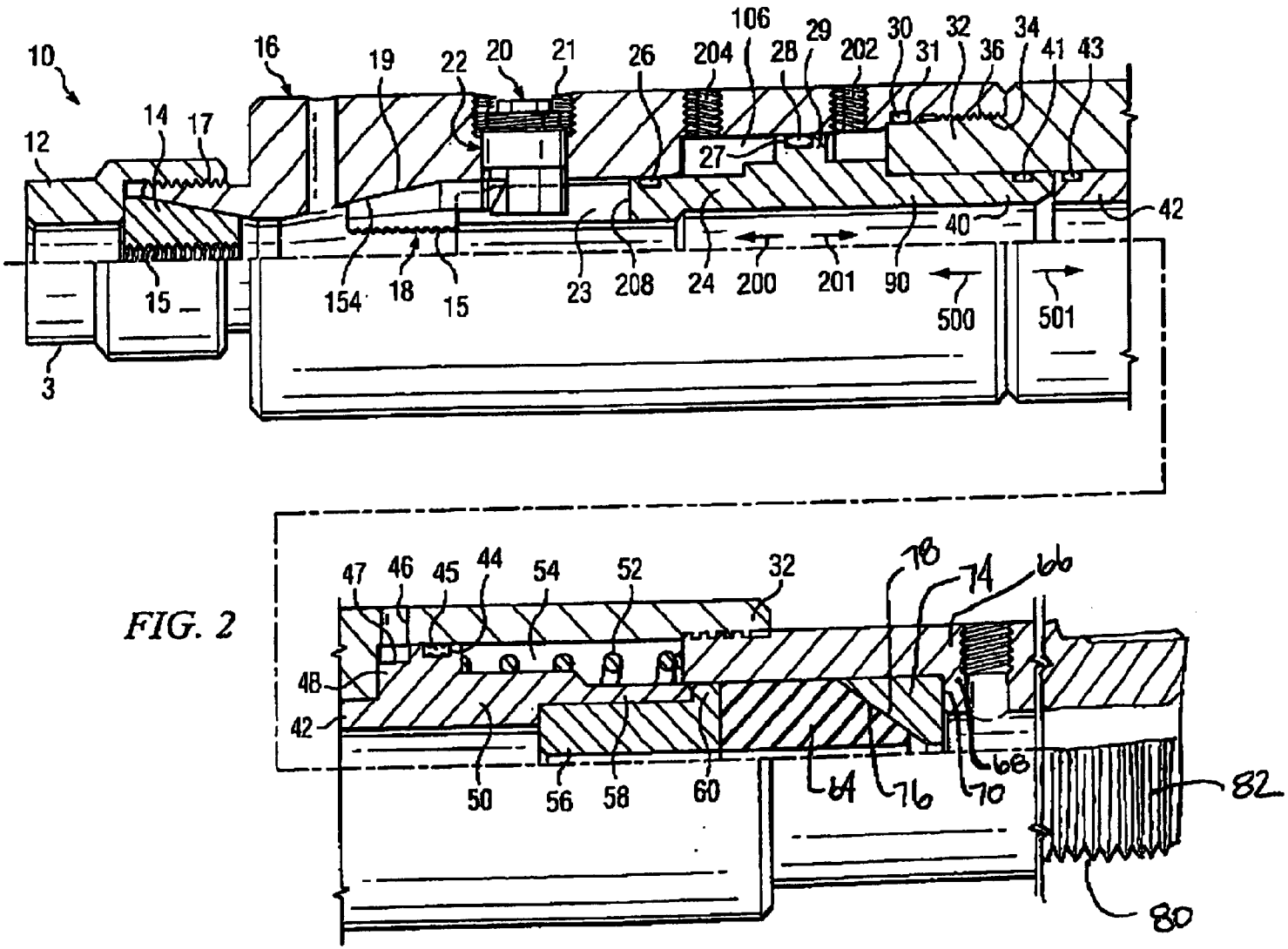
FIG. 2 is an enlarged, side-elevational, cross-sectional view of the capillary tubing pack-off of the present invention with portions thereof cut away for illustrating the assembly thereof.

Referring now to FIG. 2, there is shown an enlarged side-elevational, partially-cross-sectional view of the capillary tubing pack-off 10 of the present invention. The presence of a capillary tube is not shown for purposes of clarity. The pack-off 10 includes an upper unit 500 and a lower unit 501 adapted for receiving a capillary tube axially therethrough, and in axial alignment with a central axis 100. Upper unit 500 includes a slip cap 12 disposed on the first terminal end 13 thereof. A plurality of manual upper slips 14 are disposed within the slip cap 12 with serrated teeth 15 facing radially inwardly therefrom for engagement of capillary tubing (not shown) extending through the capillary tubing pack-off 10. The upper unit further comprises a body 16 having a threaded portion 17 adapted for threadably engaging the slip cap 12 as shown herein. The body 16 is constructed for receipt of a plurality of hydraulic lower slips 18 disposed along an inclined surface 19 formed therein. A threaded aperture 21 is formed in cylindrical wall 23 of the body 16 adapted for receipt of a slide 22 and a plug 20 therein. A separate aperture 21, slide 22, and plug 20 is provided for and adapted for engagement with each of the plurality of lower slips 18 in a manner described in more detail below.

Still referring to FIG. 2, there is shown the body 16 of upper unit 500 constructed with the cylindrical wall 23, within which is disposed, for reciprocation therein, a piston 24. The piston 24 is disposed in sealing engagement with a cylindrical wall 23 through an o-ring 26 disposed therebetween. A second o-ring 28 is disposed in a groove 27 of an upstanding cylindrical boss 29 formed around the piston 24 that is described in more detail below. Likewise, a third o-ring 30 is disposed between an inside surface 31 of the body 16 and an upper internal surface of a cap 32. The cap 32 forms the upper region of lower unit 501 and is constructed with an outwardly facing thread portion 34 adapted for engagement with an inwardly facing threaded surface 36 of the lower end of body 16. The cap 32 is configured for receiving a lower end 40 of piston 24 with an o-ring 41 disposed therebetween. Axially disposed within the cap 32 is a reciprocating plunger 42 sealed thereagainst through an o-ring 43. Likewise a second o-ring 45 is disposed around an upper boss 44 of the plunger 42 for sealing against the inside of the cap 32. The plunger 42 is also constructed with a reduced neck portion 50 adapted for receiving a spring 52 therearound. The spring is disposed in space 54 formed between the plunger 42 and the inside surface of the cap 32 for purposes of biasing the plunger 42 upwardly. A threaded aperture 46 is formed in the sidewall of cap 32 and permits hydraulic fluid to enter and egress space 47, formed between intermediate portion 48 of plunger 42 and the sidewall of cap 32. Furthermore, the space 47 is separated from the space 54 by upper boss 44 and sealed thereagainst by second o-ring 45.

Referring still to FIG. 2, and, in particular, further aspects of the lower unit 501 of the capillary tubing pack-off 10 of the present invention, a steel upper bushing set 56 is disposed within a lower end 58 of the plunger 42. The steel upper bushing set 56 is formed with a radially extending neck region 60 that abuts the terminal end of the plunger 42 on a first side and abuts an elastomeric compressible sealing member 64, preferably formed of rubber or the like, on the opposite side thereof. The sealing member 64 is disposed in axial alignment with the steel upper bushing 56 and within the walls of an extended base 66. Extended base 66 is formed with a lower base portion 68 forming a shoulder 70 facing upperwardly therefrom toward the sealing member 64 and upon which a lower bushing set 74 is disposed. It may be seen that the lower bushing set 74 is sandwiched between the shoulder 70 and an angulated surface 76 of the sealing member 64. The angulated surface 76 is formed at angle that matingly engages in abutting relationship therewith angulated surface 78 of the lower bushing set 74, also preferably formed of steel. The lower base portion 80 of the extended base 66 is further formed with threads 82 formed circumferentially therearound adapted for threadably engaging mating wellhead equipment.

The above provides a description of the general assembly of the capillary tubing pack-off 10 of the present invention. A description of many of the individual elements forming portions thereof will be described in more detail below. What is common in the assemblage, however, of the above-described elements is the fact that a central aperture 100 is formed therethrough, as indicated by the phantom line of central axis 100 therein. The aperture along axis 100 is adapted for receipt of capillary tubing therein, as referenced above. Actuation of the capillary tubing pack-off 10, in the manner described herein, allows selective engagement and disengagement of the capillary tubing disposed within the capillary tubing pack-off for purposes of installing, removing, and locking capillary tubing within a well.

Figure 3:
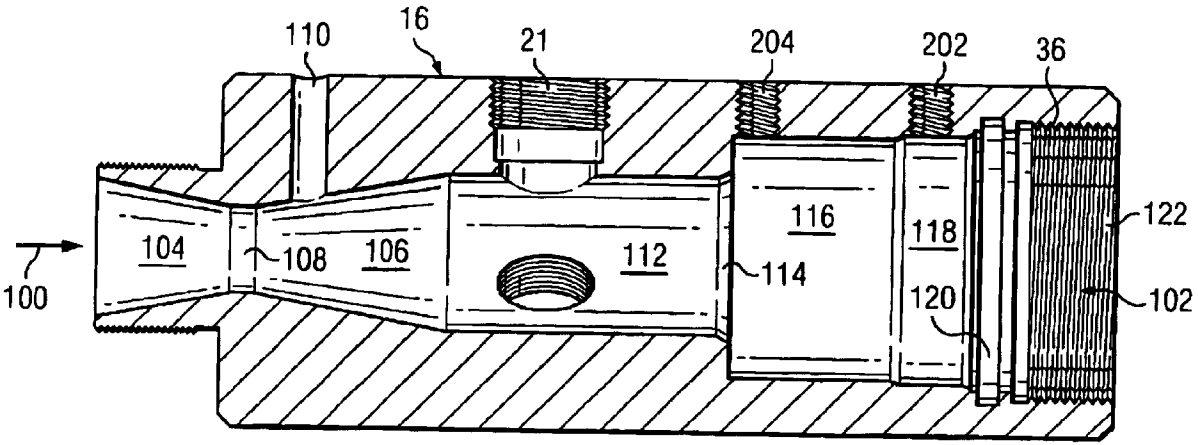
FIG. 3 is a side-elevational, full cross-sectional view of the upper body of the capillary tubing pack-off of FIG. 2, illustrating one aspect of the fabrication thereof.

Referring now to FIG. 3, there is shown a side-elevational, full cross-sectional view of the body 16 of FIG. 2, with all other elements of the capillary pack-off 10 illustrated in FIG. 2 in association therewith removed for purposes of clarity. In this particular view, the fabrication of the body 16 can be more clearly understood as well as certain functional aspects thereof. For example, body 16 includes the threaded apertures 21 (preferably three) adapted for receiving the slides 22 and the plugs 20 (shown as FIG. 2) therein. The construction and operation of the threaded apertures 21 and slides 22 will be described in more detail below. What is clearly shown herein is the multi-chambered axial bore 102 of the body 16 facilitating the receipt of the above-referenced elements therein for the operation thereof, and in axial alignment with central axis 100. The bore 102 includes first and second conical sections 104 and 106 oppositely disposed about a cylindrical region 108 sandwiched therebetween. An aperture 110 is formed in a sidewall body 16 in communication with chamber 106. The Aperture 110 provides a means of visually confirming that the slips 18 are in position to engage the capillary tubing, while the aperture 21 provides outside communication into a cylindrical chamber 112 disposed contiguous to the conical section 106. A conical transition section 114 provides communication between the chamber 112 and a cylindrical chamber 116 formed upwardly of a cylindrical region 118. The inside diameter of the body 16 is increased to provide a cylindrical region 120 above and in communication with a lower-most region 122. The sidewalls of the lower-most region 122 form inwardly facing threaded surface 36 for threaded engagement with cap 32. As described above, the various bore diameters are necessitated for receipt, adaptation and operation of the various elements described, set forth and shown in FIG. 2.

Still referring to FIG. 3, the sidewall of the body 16 includes a first threaded aperture 204 providing communication into the region 116 while a second threaded aperture 202 provides communication into the chamber 118. Finally, the walls of the lower-most region 122 are formed with the threads 36, referenced above.

Figure 4:
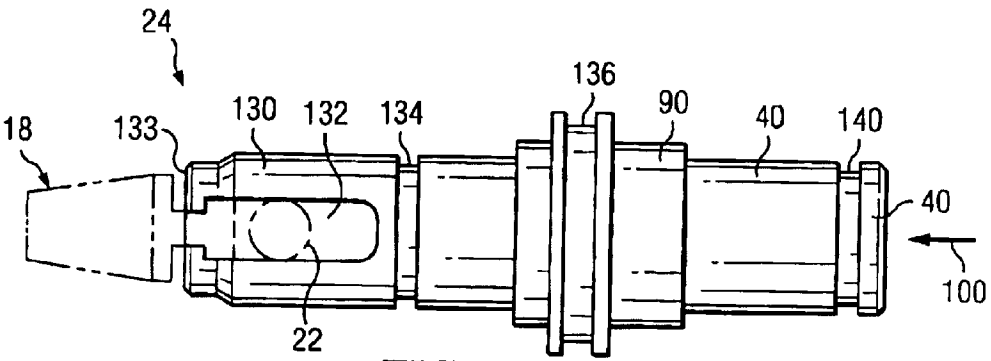
FIG. 4 is a side-elevational view of the piston for the capillary tubing pack-off of FIG. 2.

Referring now to FIG. 4, there is shown a top plan view of the piston 24 of FIG. 2. The piston 24 is constructed with an upper body portion 130 formed with slots 132 (preferably three) therein. The slot 132 is adapted for receiving the slides 22 and the lower slips 18, as represented in phantom. Likewise, the piston 24 is constructed with a groove 134 adapted for receiving o-ring 26 as shown in FIG. 2. An o-ring may also be mounted around the piston 24 within the boss 29 extending therearound and adjacent to intermediate portion 90 of the piston 24. An o-ring groove 142 is also formed in the lower end 40 of the piston 24.

Figure 5A:
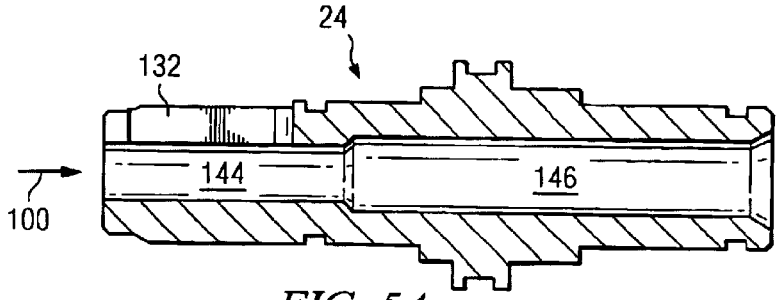
FIGS. 5A and 5B comprise a side-elevational, full cross-sectional and frontal view, respectively, of the piston shown in FIG. 4.
Figure 5B:
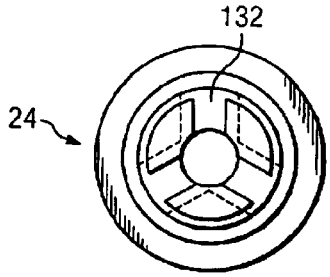

Referring to FIGS. 5A and 5B in combination, there is shown a side-elevational, partially cross-sectional and frontal view, respectively, of the piston 24 of FIG. 4. The slots 132, as shown in FIG. 4, may be seen to comprise an elongated section thereof exposing a central bore 144 therein. The central bore 144 is formed concentrically about the axis 100, as is central chamber 146 formed adjacent thereto. The reciprocal actuation of the piston 24 within the capillary tubing pack-off 10 will be described in more detail below.

Figure 6A:
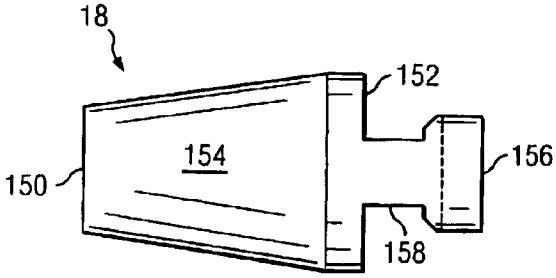
FIGS. 6A, 6B and 6C are multiple views of the fabricated slip of the capillary tubing pack-off of FIG. 2 illustrating various aspects of the fabrication thereof.

Referring now to FIG. 6A, there is shown an enlarged top plan view of one hydraulic lower slip 18 (preferably of the set of three, although other numerical combinations may be used). The slip 18 includes a frontal face 150 and a rear face 152 wherein an angled body portion 154 extends therebetween. A key section 156 is disposed rearwardly thereof and extends therefrom by neck region 158.

Figure 6B:
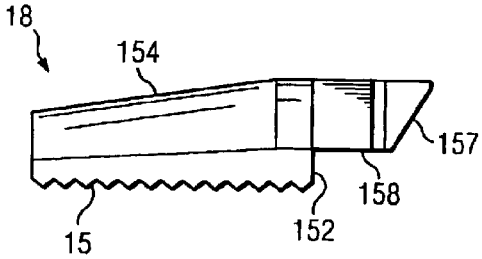

Referring now to FIG. 6B, there is shown a side-elevational view of the hydraulic lower slip 18, illustrating aspects in the manufacturing thereof. The neck region 158 of the key section 156 may be seen relative to the surface 152. The slip 18 is formed with a plurality of serrated teeth 15, which teeth may be of similar shape as those set forth and described relative to the manual upper slips 14 described above. The key section 156 has an angled rear surface 157 for sliding engagement with slide 22, described in more detail below.

Figure 6C:
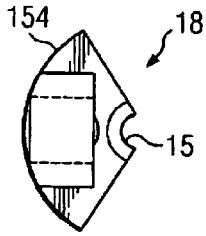

Referring now to FIG. 6C, there is shown an end-elevational view of the hydraulic lower slip 18 illustrating other aspects of the manufacture thereof. As will be seen, the serrated teeth 15 comprise a relatively small section of the hydraulic lower slip 18 and are disposed inwardly in a position adapted for engagement with the capillary tubing placed therethrough as will be described in more detail below.

Figure 7A:
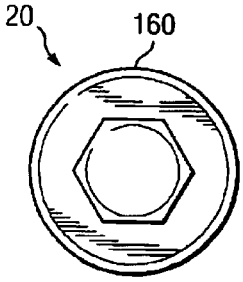
FIGS. 7A and 7B are top plan and side-elevational views, respectively, of the plug of the capillary tubing pack-off of FIG. 2.
Figure 7B:
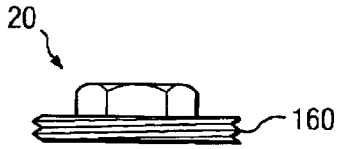

Referring now to FIGS. 7A and 7B in combination, there is shown a top plan and a side elevational view of one plug 20 (preferably 3) of the capillary tubing pack-off of FIG. 2. The plug 20 is constructed with a threaded side portion 160 adapted for threaded engagement with the threaded aperture 21 formed in the capillary tubing pack-off 10. As shown in FIG. 2, the plug 20 is disposed atop the slide 22 for positioning the slide 22 relative to the sidewall of the cylindrical chamber 112 of the body 16 of the capillary tubing pack-off 10. The placement of the slide facilitates the actuation of the hydraulic lower slips 18, as will be described in more detail below.

Referring now to FIGS. 8A through 8D in combination, there is shown one of the above-referenced slides 22. In these particular views, the manufacturing of the slide may be more clearly seen and, in particular, the construction of the angulated surface therein facilitating engagement with the angled surface 157 of the lower slips 18 discussed above.

Figure 8A:
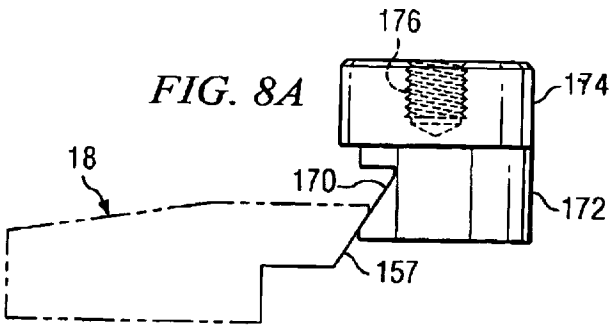
FIGS. 8A through 8C comprise multiple views of the slide for the capillary tubing pack-off of FIG. 2.

Referring specifically now to FIG. 8A, there is shown a side elevational view of the slide wherein angulated surface 170 is shown to be disposed across body section 172 for facilitating sliding engagement with the angled rear surface 157 of the hydraulic lower slip 18, as represented in phantom. Body section 172 is disposed beneath a head section 174 having a threaded aperture 176 formed therein. The threaded aperture 176 enables the slide 22 to be extracted with a bolt (not shown) after removing the plug 20.

Figure 8B:
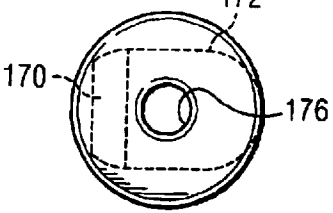

Referring now to FIG. 8B, a top plan view of the slide 22 of FIG. 8A is set forth and shown. The aperture 176 is most clearly shown in this particular view while the angulated surface 170 of body section 172 is shown in phantom.

Figure 8C:
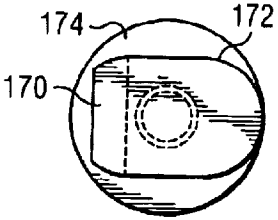

Referring now to FIG. 8C, the slide 22 of FIG. 8A is shown in a bottom plan view wherein the body portion 172 is shown to be formed with the slide surface 170 shown in phantom and the shape of which is most clearly set forth and illustrated as it is disposed beneath the larger head section 174.

Figure 9A:
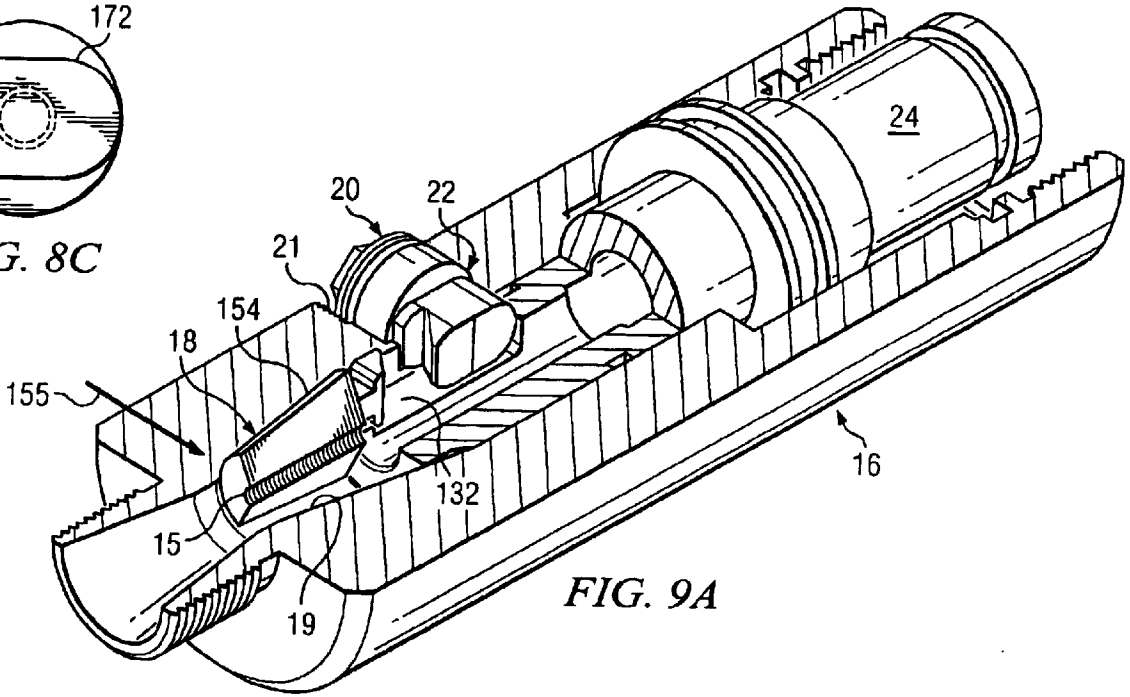
FIGS. 9A through 9C comprise multiple views of a perspective, cross-sectional view of the upper body portion of the capillary tubing pack-off of FIG. 2 with portions thereof cut away for illustrating the engagement and disengagement of the slips within the capillary tubing pack-off of FIG. 2.
Figure 9B:
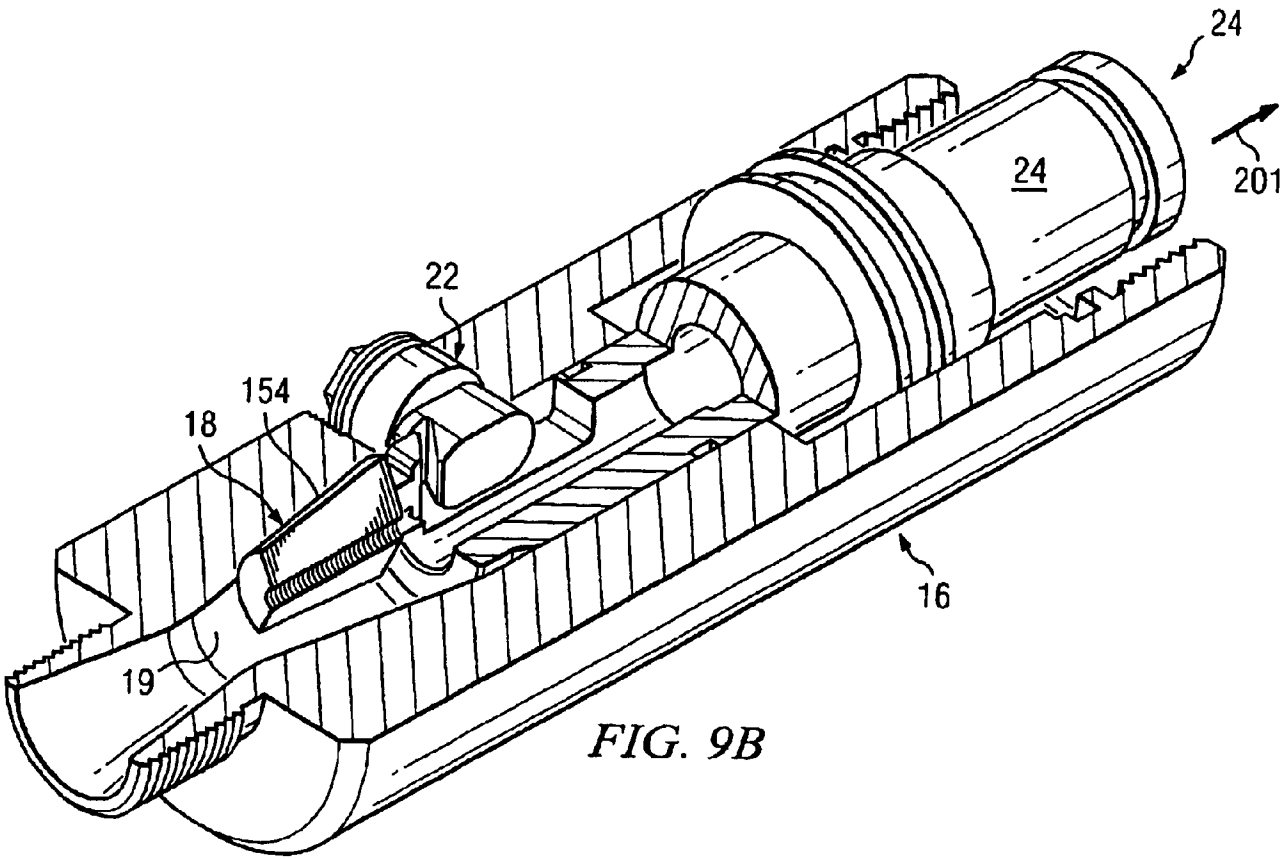
Figure 9C:
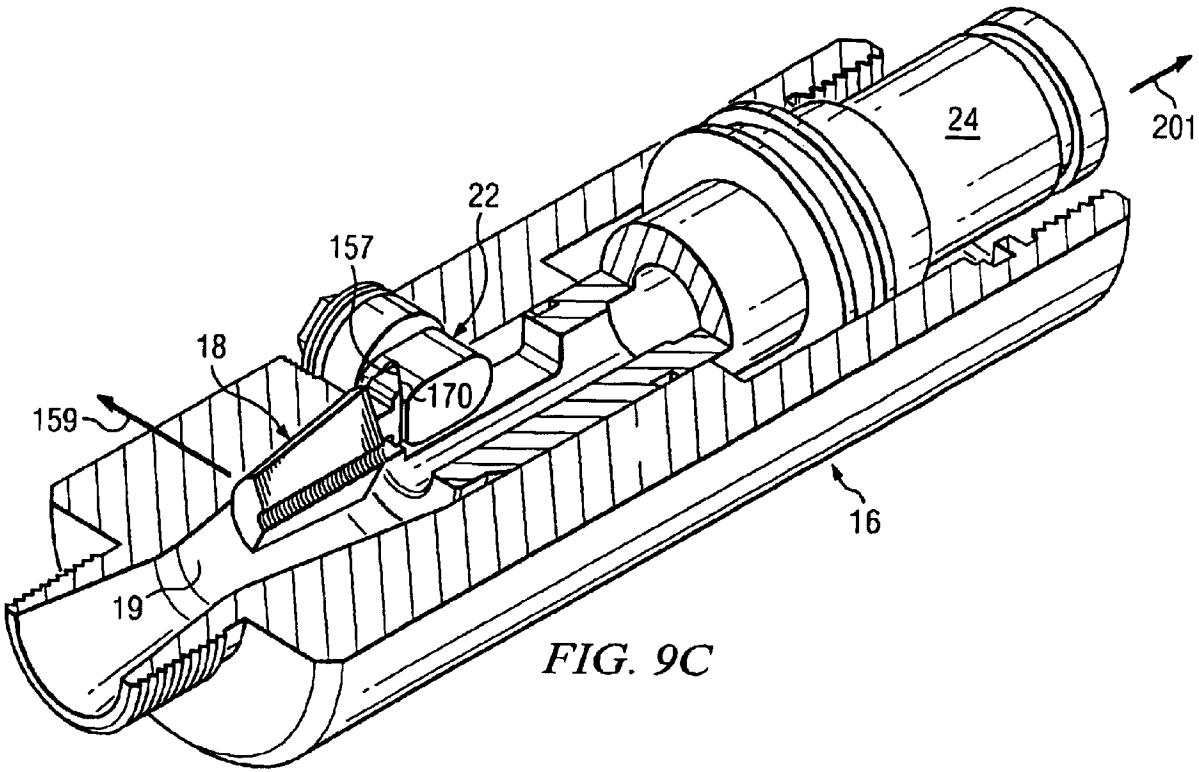

Referring now to FIGS. 9A through 9C in combination, there is shown a perspective view of a cutaway portion of the piston 24 and the body 16, with one of the slides 22, and slips 18, contained therein, illustrating the engagement one with the other for purposes of description of the operation thereof within the capillary tubing pack-off 10. In these particular views, the engagement of the hydraulic lower slip 18 by slide 22 may be more clearly seen during retraction of the slip 18 by piston 24 in direction of arrow 201.

Referring specifically now to FIG. 9A, there is shown the piston 24 and the slip 18 in an engaged position, with the slide 22 inserted through the threaded aperture 21 and slot 132 of piston 24. The plug 20 is not shown for purposes of clarity.

In the engaged position, forward motion of the piston 24 induces forward movement of the slip 18 by virtue of the interlocking relationship thereof, whereby the angulated surface 154 bears against the angulated surface 19 of the body 16, imparting inwardly radially directed motion to the slip 18, as depicted by arrow 155. The inwardly radial direction of movement of the slip 18 along the direction of the arrow 155 will cause the teeth 15 thereof to bear against capillary tubing (not shown) extending axially therethrough.

Referring to FIG. 9B, there is shown the same view as in FIG. 9A, illustrating a transitional stage during retraction by the piston 24 of the slip 18. As discussed above, movement along the arrow 201 will impart a radially outwardly motion to the slip 18. During a portion of this retraction, however, the teeth 15 remain engaged with the tubing due to the radially inwardly force imparted by the angulated surface 19 of the body 16 to the angulated surface 154 of the slip 18.

Referring now to FIG. 9C, there is shown the same view as in FIGS. 9A and 9B, illustrating the engagement of slide 22 and slip 18 by the motion of the slip 18 imparted by the piston 24 during retraction in the direction of arrow 201. It may be seen that the angulated surface 170 of the slide 22 engages the slip 18 across the angulated surface 157 thereof. Movement of the piston 24 induces the angulated surface 157 of the slip 18 to abut the angulated surface 170 of the slide 22, whereby the slip 18 is induced to move radially outwardly along the surface 170 of the side 22 disengaging teeth 15 from the tubing, as depicted by arrow 159.

While the construction and operation of the capillary tubing pack-off of the present invention may be clearly set forth and shown herein, the assembly thereof also should be addressed. The interlocking engagement between the slips 18 and the piston 24 necessitates assembly one with the other within the body 16 of the capillary tubing pack-off 10 for subsequent insertion of the slide 22 for positioning therebetween. As referenced above, the function of the slide 22 is to impart radially outwardly movement of the slip 18 during the retraction thereof in the direction of arrow 201 by virtue of the angled surface 157 of slip 18 engaging surface 170 of slide 22.

Referring back now to FIG. 2, the overall operation of the capillary tubing pack-off 10 of the present invention will now be more clearly described. The capillary tubing pack-off 10 basically comprises the lower unit 501 and the upper unit 500. The lower unit 501 comprises a first clamping means using the sealing member 64. The upper unit 500 comprises a second clamping means using the plurality of hydraulic lower slips 18 and a third clamping means using the manual slips 14.

"Referring still to FIG. 2, and in particular to the lower unit 501, which has been described in detail above. The lower unit 501 serves to provide a first clamping means for controlling the movement of small diameter tubing into and out of wells by providing an hydraulically actuatable clamping mechanism working in conjunction with a conventional elastomeric compression pack-off. The use of hydraulically actuated elastomeric pack-offs to seal capillary tubing is known in the art. In that regard, lower unit 501 includes a conventional hydraulically actuated pack-off. It may be seen that hydraulic fluid injected through port 46 into space 47 of the capillary tubing pack-off lower unit 501 will cause movement of the plunger 42 therein against spring 52 and against the upper bushing 56 which bears against sealing member 64. Sealing member 64 is constructed with an angulated surface 76 which bears against angulated surface 78 of the lower bushing 74 whereby radially inwardly directed expansion is imparted for engaging capillary tubing disposed therein. As stated above, this type of hydraulic actuation utilizing a plunger and a compressible member is accepted in the industry. What is not of standard acceptance is the use of means for actuation of a series of mechanical locking members such as the hydraulic lower slips 18 having teeth 15 formed along an inner surface thereof (shown in FIG. 6A–60) for engagement of the capillary tubing extending therethrough. In the lower unit 501 of FIG. 2, a first clamping" mechanism is provided by the sealing member 64. The sealing member 64 provides the requisite sealing of the capillary tubing and a degree of securement thereagainst. In high pressure situations, it is, however, potentially problematic to have the sole means for securing capillary tubing the sealing member 64 for which only a smooth frictional surface is afforded therewith. For this reason, in the upper unit 500, a second clamping mechanism is provided by the hydraulic lower slips 18 which greatly improve the reliability, safety and efficiency of such wellhead operations.

Referring specifically now to the upper unit 500 and the operation of the second claimping means comprising the plurality of slips 18 described above in FIG. 2, the slips 18 may be used (preferably three) to arrest the upward motion of the capillary tubing in an emergency situation. The slips 18 are positioned by virtue of the piston 24 that is hydraulically actuated to move in a first upward direction along arrow 200 in response to hydraulic fluid flowing through the aperture 202 and bearing thereagainst. The aperture 204 allows expulsion of any hydraulic fluid contained in cavity 206 defined therebeneath and around the upper region of piston 24. Movement of the piston 24 in the direction of arrow 200 then imparts movement to the slips 18 disposed axially against the end 133 of the piston 24. It may be seen that the slot 132 (FIGS. 4 and 5), provided for each of the plurality of slips, permits an abutting relationship between the end 133 of the piston 24 (shown in FIG. 4) and the surface 152 of the slip 18 (shown in FIGS. 6A and 6B). Movement of the piston 24 in the direction of the arrow 200 thus imparts movement of the slips 18 in the same direction, which by virtue of the angled interface along the surface 19 induces the slips 18 to move radially inwardly in a clamping action, similar to the jaws of a chuck, against an object such as a capillary tube extending axially through the capillary tubing pack-off 10. The teeth 15 then are positioned to physically engage the surface of the capillary tube for securement thereof actuated by the hydraulic pressure imparted thereto. Likewise, release of the hydraulic fluid through the aperture 202 while hydraulic fluid is injected through the aperture 204 will cause the piston 24 to move in the direction of the arrow 201, and the movement will likewise cause movement of the slips 18 in the direction of the arrow 201 by virtue of the interlocking relationship therebetween. As discussed above in relation to FIGS. 9A through 9C, the teeth 15 of the slips 18 continues to engage the surface of the capillary tube due to the radially inwardly force exerted on the angled surfaces 154 of the slips 18, until angled surfaces 170 of the slides 22 (one slide is provided for each slip) engage the angled surfaces 157 of the slips 18, thereby imparting a radially outwardly motion to the slips 18, disengaging the teeth 15 from the surface of the capillary tubing.

"Referring still to FIG. 2, and, in particular to the third clamping mechanism set forth and described above in the upper unit 500 comprising the manual upper slips 14 which may be provided in a series of two or more (preferably three) and are manually positioned for clamping action relative to the slip cap 12. In operation, however, the manual upper slips 14 described above which are actuated by the slip cap 12 are typically not in place on the capillary tubing pack-off 10 of the present invention, although they are positioned around the capillary tubing being fed thereto. The third clamping mechanism is utilized once the capillary tubing reaches a certain depth and is cutoff from the tubing reel on the service rig to suspend the tubing and prevent it from being pulled down by gravity. In an emergency situation, however, there are generally two means available to an operator to control the movement of capillary tubing in the pack-off 10 of the present invention. The first clamping means, as discussed above, is the hydraulic actuation of the sealing member 64 which permits sealing and securement of the capillary tube as long as the pressures within the well do not exceed that capable of being handled by such sealing members. If the well pressure becomes great enough, the operator of the" pack-off 10 of the present invention is able to connect and have available to him the ability to immediately hydraulically actuate a mechanical chuck in the form of the plurality of hydraulic lower slips 18 described above for secured engagement of the capillary tubing extending through the pack-off 10.

It should also be noted that the specification of the o-rings presented herein are for purposes of illustrating the requirement for sealing, as is typical in most hydraulic actuation systems due to the high pressures involved in the system, the multiple use of o-rings is deemed a preferred embodiment.

Although a preferred embodiment of the invention as been illustrated in the accompanying drawings and described in the foregoing specification, the wellhead is capable of numerous rearrangements and modifications of parts and elements without departing from the spirit of the invention.

I claim:

1. A wellhead pack-off system for controlling the movement of small diameter tubing into and out of a well, comprising:

a body having a bore therethrough for insertion of said tubing;

first means slidably coupled into said bore of said body for frictionally restraining movement of said tubing by hydraulically engaging the periphery of said tubing with an elastomeric compressible sealing member; and second means slidably coupled into said bore of said body for preventing movement of said tubing in said bore of said body by hydraulically actuating a plurality of slips to impart select engagement or disengagement of the periphery of said tubing for its securement therein; and wherein said tubing is susnended in said bore of said body by a third means by manually engaging a plurality of suspension slips around the periphery of said tubing.

2. The wellhead pack off system of claim 1, wherein the body further comprises a lower unit in threaded engagement to an upper unit, wherein said first means is operable in said lower unit and said second means is operable in said upper unit.

3. The wellhead pack off system of claim 2, wherein said upper unit comprises:

a first cylindrical chamber;

a first threaded aperture formed in the sidewall of said first cylindrical chamber and in communication therewith;

a second cylindrical chamber formed downwardly of said first cylindrical chamber and in communication therewith;

a second aperture formed in the sidewall of said second cylindrical chamber and in communication therewith.

4. The wellhead pack off system of claim 3, wherein the second means comprises:

a slide member slidably coupled within said first aperture and extending through the sidewall of said first cylindrical chamber and engaging said plurality of slips;

a plug adapted for threaded engagement with said first aperture and disposed atop said slide for positioning said slide relative to the sidewall of said first cylindrical chamber; and a hollow cylindrical piston slidably coupled with said first and second cylindrical chambers of said upper unit and surrounding a capillary tube, wherein said piston hydraulically engages said slide and said plurality of slips so as to cause engagement or disengagement of said plurality of slips with said capillary tube.

5. The wellhead pack off system of claim 4, wherein at least one slip of the plurality of slips further comprises:

a front face;

a rear face in abutting engagement with said piston;

an angled body portion planar with and abutting a first conical section of said upper unit and extending between said front face and said rear face;

a key section disposed rearwardly of said rear face and slidably engaging said piston and said slide; and a plurality of teeth positioned to engage the periphery of said tubing for securement thereof, whereby movement of said slip inwardly toward said tubing disposed axially therethrough would necessitate movement of said slip upwardly, such that said angulated surface of said slip bears against the sidewall of said first conical section causing inwardly radially directed motion thereof.

6. The wellhead pack off system of claim 5, wherein the slide comprises:

a head section abutting said plug;

a body section disposed beneath said head section; and an angulated surface section disposed across said body section and bearing against said slip.

7. The wellhead pack off system of claim 6, wherein said key section of said slip comprises:

a neck portion extending from said rear face of said slip; and an angulated surface section extending rearwards of said neck portion and in abutting engagement with said angulated surface of said slide, whereby movement of said slip outwardly away from said tubing disposed axially therethrough said bore of said body would necessitate movement of said slip toward said slide, such that said angulated surface of said key section of said slip bears against said angulated surface of said slide causing outwardly radially directed motion thereof.

8. The wellhead pack off system of claim 7, wherein said hollow cylindrical piston further comprises:

an upper body portion slidably coupled into said first cylindrical chamber of said upper unit, and having an inner diameter greater than the diameter of said capillary tube;

a slot comprising an elongated section for receiving said key section of said slip and said body of said slide;

a recessed neck portion for providing a sealing means between the first cylindrical chamber from the second cylindrical chamber; and a boss portion operable to facilitate movement of said piston in an axial direction, wherein said boss portion reacts to force exerted through said second aperture or said third aperture to engage or disengage said slip from said tubing.

9. The wellhead pack off system of claim 3, wherein said lower unit comprises:

a cylindrical cap section in threaded engagement with said second cylindrical chamber and having a fourth aperture; and an extended base in threaded engagement with said cap and having a lower base portion.

10. The wellhead pack off system of claim 9, wherein the first means comprises:

a plunger axially disposed within said cap having a reduced neck portion forming a first cavity between said plunger and said sidewall of said cap and having a lower end and an upper boss forming a second cavity between the opening of said fourth aperture of said cylindrical cap section and said first cavity;

a spring disposed within said cavity for purposes of the flexing thereof and urging movement against said plunger;

a steel upper bushing set disposed within the lower end of said plunger, said upper bushing set having a first side abutting the terminal end of said plunger and a second side;

a steel lower bushing set disposed upon and in alignment with the lower portion of said extended base, and having an angulated surface;

a second compressible member disposed in axial alignment with said upper bushing and within the walls of said extended base, and having an angulated surface in abutting relationship with the angulated surface of said lower bushing set and an opposite surface in abutting relationship with said second side of said upper bushing set.

11. The wellhead pack-off system of claim 5, wherein said upper unit further comprises a second conical section in communication with said first conical section.

12. The wellhead pack-off system of claim 11, wherein said second conical section having a sidewall engaging said plurality of suspension slips is adapted for receiving said plurality of suspension slips.

13. The wellhead pack-off system of claim 11, wherein said third means further comprises a slip cap in threaded engagement with said upper unit for manually engaging said suspension slips with said tubing.

14. A method for controlling the movement of small diameter tubing into and out of a well, comprising the steps of:

inserting said tubing into a body having a bore therethrough;

frictionally restraining movement of said tubing by hydraulically engaging the periphery of said tube with an elastomeric compressible sealing member, the step of frictionally restraining further comprising the step of hydraulically engaging a plunger so as to compress said sealing member, thereby forming a seal around the periphery of said tubing and frictionally restraining movement of said tubing;

preventing movement of said tubing in said bore of said body by hydraulically actuating a plurality of slips to impart select engagement of the periphery of said tubing for its securement therein, the step of preventing movement further comprising the step of engaging a piston so as to cause selective engagement or disengagement of said plurality of slips with said tubing;

engaging said slip with said tubing by imparting a radially inwardly motion to said plurality of slips;

disengaging said slip with said tubing by imparting a radially outwardly motion to said plurality of slips; and suspending said tubing in said bore of said body by manually engaging a plurality of suspension slips around the periphery of said tubing.

* * * * *